United States Patent [19]

Shenier et al.

[11] Patent Number: 4,825,526

[45] Date of Patent: May 2, 1989

[54] MAGNETIC FASTENER

[75] Inventors: Richard S. Shenier, East Williston, N.Y.; Richard J. Peterson, Paramus, N.J.

[73] Assignee: C & C Metal Products Corporation, Englewood, N.J.

[21] Appl. No.: 544,211

[22] Filed: Oct. 21, 1983

[51] Int. Cl.[4] ..... A44B 17/00

[52] U.S. Cl. ..... 24/303; 335/285

[58] Field of Search ..... 24/303, DIG. 1; 292/251.5; 335/285; 248/206.5

[56] References Cited

U.S. PATENT DOCUMENTS

| | | | |
|---|---|---|---|
| 2,964,275 | 12/1960 | Atkinson | 248/206.5 X |
| 2,975,497 | 3/1961 | Budreck | 24/303 |
| 3,009,225 | 11/1961 | Budreck | 24/303 |
| 3,086,268 | 4/1963 | Chaffin, Jr. | 335/285 X |
| 3,171,176 | 3/1965 | Shirley | 335/285 X |
| 3,277,681 | 10/1966 | Bey | 24/303 X |
| 3,304,527 | 2/1967 | Marrs et al. | 335/285 |
| 4,021,891 | 5/1977 | Morita | 24/303 |
| 4,200,852 | 4/1980 | Aoki | 24/303 |
| 4,458,395 | 7/1984 | Aoki | 24/303 |

FOREIGN PATENT DOCUMENTS

| | | | |
|---|---|---|---|
| 58-10808 | 1/1983 | Japan | 335/285 |

*Primary Examiner*—Peter A. Aschenbrenner

*Attorney, Agent, or Firm*—Shenier & O'Connor

[57] ABSTRACT

A magnetic fastener wherein magnetic flux from a permanent magnet flows to and from a permeable planar armature through air gaps of substantially equal areas which are small compared with the area of either face of the magnet.

20 Claims, 1 Drawing Sheet

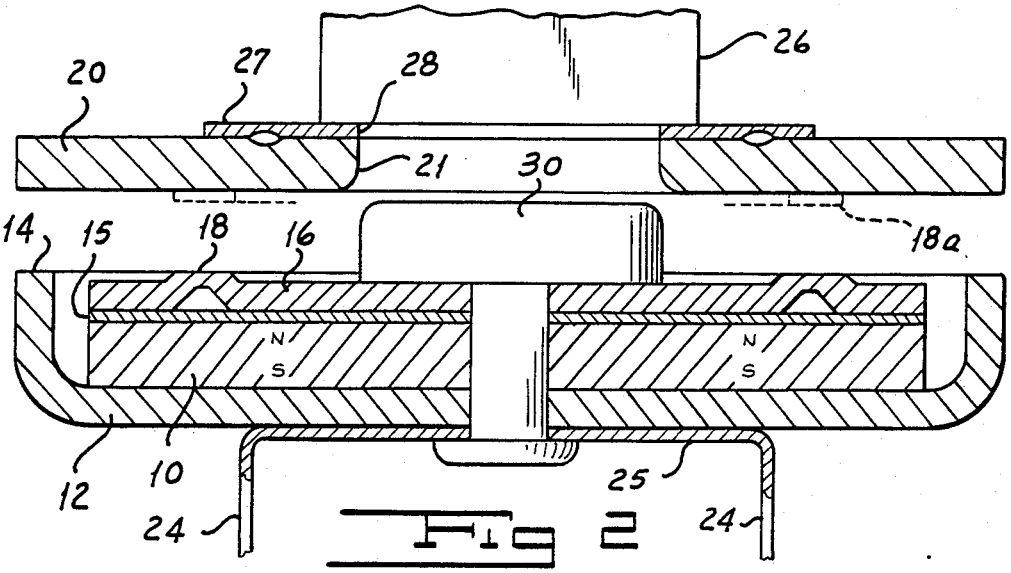
Fig 2
Fig 1
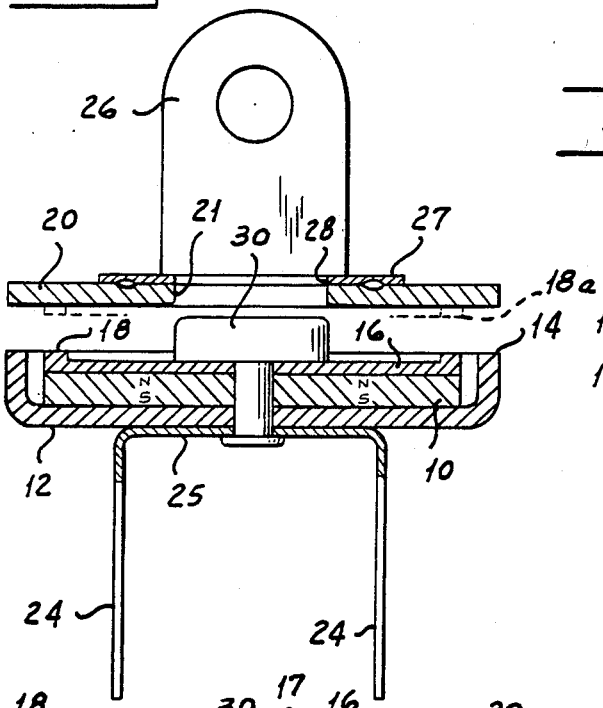
Fig 3
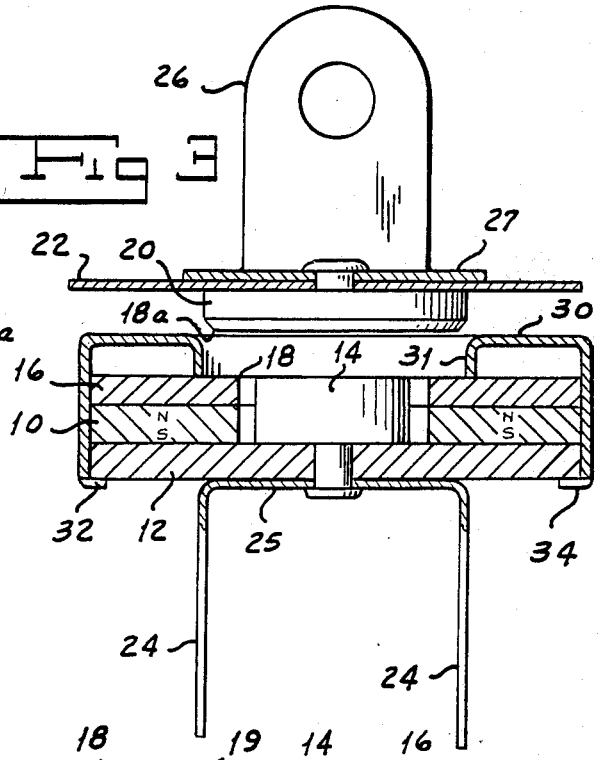
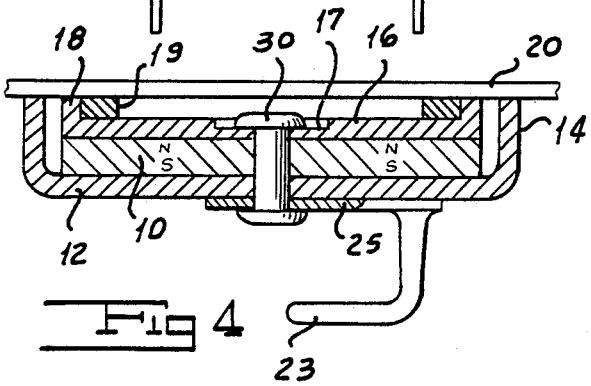
Fig 4
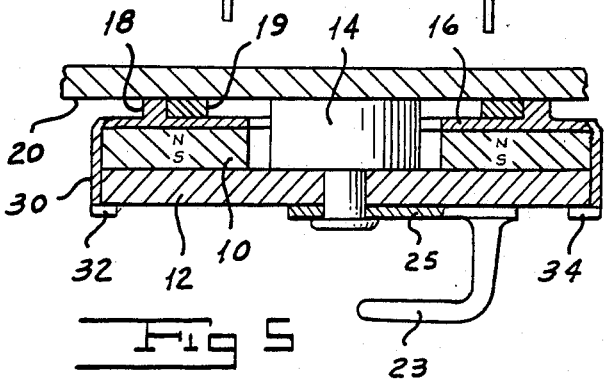
Fig 5

MAGNETIC FASTENER

BACKGROUND OF THE INVENTION

Magnetic fasteners commonly employ a relatively thin circular disk of magnetic material the upper face of which is a north pole and the lower face of which is a south pole. Flux from the upper north pole passes upwardly to an armature made of a permeable material; and the flux entering the armature is returned to the lower south pole either through a central rod of permeable material or the peripheral rim of a cup in which the permanent magnet is mounted. The peripheral rim of the permeable cup or the central permeable rod has an area appreciably less than that of either of the faces of the permanent magnet. The high flux concentration in either the annular rim of the cup or the central rod provides the essential holding force for the magnetic fastener against the armature.

SUMMARY OF THE INVENTION

In general, our invention contemplates a magnetic fastener wherein the upper or north pole of the magnet is covered with a layer of permeable material sufficiently thick to permit appreciable lateral flux flow therethrough. The cover plate is provided with an upstanding pole, or the armature is provided with a depending pole, so that the area through which flux flows upwardly from the north pole to the armature is reduced to substantially the same polar area through which flux flows downwardly from the armature to the annular rim of the cup or to the central rod.

As is well known to the art, the force of magnetic pull is $P=B^2A$ where B is the air gap flux density and A is the air gap area. The total flux $\phi$ flowing through the magnetic circuit is $\phi=BA$. Accordingly, the magnetic pull force is $P=B\phi$. The total flux is governed by the area of either face of the permanent magnet; and $\phi=B_mA_m$ where $B_m$ is substantially the remanent or residual induction of the permanent magnet, which may be approximately 2000 gauss, and $A_m$ is the area of either face of the magnet. Since the saturation induction of permeable materials such as iron and steel may range as high as 20,000 gauss, such permeable materials can provide an appreciably greater air gap flux density than a permanent magnet. Assuming a remanent or residual induction of 2,000 gauss for the permanent magnet and a flux density of 16,000 gauss in the permeable iron or steel material, such permeable material can provide an increase in the air gap flux density by a factor of eight.

In magnetic fasteners of the prior art, the magnetic pull between the north pole of the magnet and the armature may be 13%; and the magnetic pull between the armature and the permeable peripheral rim or central rod may be 100% because of the increased flux density. The total magnetic pull between the armature and the remaining portion of the magnetic circuit may be $100+13=113\%$. In our invention, the permeable plate covering the north pole of the magnet in conjunction with the small polar area between such plate and the armature results in a magnetic pull of 100%; and the total magnetic pull between the armature and the remaining portion of the magnetic circuit is $100+100=200\%$. Thus our magnetic fastener provides $200/113=1.77$ times the holding force of fasteners of the prior art. This improvement may not be achieved in practice if the air gap flux densities become so great that the permeability of the permeable material is less than approximately 100. The equations for magnetic pull are predicated upon extremely high permeabilities for the permeable material and provide reasonable accuracy for permeabilities in excess of 100.

The Prior Art

Shirley U.S. Pat. No. 3,171,176 provides a flat disk magnet within a permeable cup, the permanent magnet is provided with a central hole. The north pole of the magnet is covered with a thin disk of plastic material. There is no flux concentration, since the air gap flux density between the north pole face of the magnet and the armature is precisely equal to that within the magnet itself.

Maurita U.S. Pat. No. 4,021,891 shows a construction wherein flux from the north pole of a permanent magnet is returned through a central permeable rod disposed within a hole in the permanent magnet. The north pole face of the magnet is covered with a thin layer of nonferromagnetic material such as brass. There is no flux concentration since the flux density in the air gap between the north pole of the permanent magnet and the armature is the same as that existing within the magnet itself.

Budrick U.S. Pat. No. 3,009,225 shows a flat disk magnet mounted within a permeable cup, the magnet being provided with a central hole. The north pole of the magnet is covered with a permeable pole piece having no hole. The magnetic holding force in Budrick is slightly less than Sirley and Maurita, since the air gap flux density between the permeable pole piece and the armature is less than that existing within the permanent magnet.

Chaffin U.S. Pat. No. 086,268 shows a construction wherein the south pole of a disk-shaped permanent magnet contacts a permeable disk of greater diameter. The armature in this case is cup shaped and the depending sidewalls provide a return path for flux to the south pole of the permanent magnet. The permanent magnet is provided with a central hole. A permeable cup-shaped pole piece having no hole covers not only the entire north pole of the permanent magnet, but also extends downwardly an appreciable portion of the height of the permanent magnet about its periphery. The air gap flux density between the permeable north pole cup and the armature is appreciably less than that in the permanent magnet itself, not only because of the central hole in the permanent magnet, but also because of the radial flux flow through the sides of the permeable north pole cup to the surrounding cup-shaped armature. This radial flux flow does not contribute to the holding force and indeed diminishes the holding force because of the reduced flux concentration in the air gap extending along the axis of the magnet.

Bay U.S. Pat. No. 3,277,681 shows a construction wherein the armature comprises a rod or plunger which extends through a central hole in the permanent magnet. The north pole of the permanent magnet is covered with a thick layer of permeable material. Flux from the north pole flows through the thick permeable layer and enters the armature radially. This radial flux flow does not contribute to magnetic pull. The entire magnetic pull of the north pole is lost, the only effective magnetic pull being that between the armature rod and the permeable south pole plate.

Assuming that the magnetic fasteners of the prior art are designed with the same permanent magnets and similar amounts of iron, the magnetic holding force of Shirley and Maurita would be 113%; the magnetic holding force of Budrick would be 110%; the magnetic holding force of Chaffin would be 103%; and the magnetic holding force of Bay would be 100%, as compared with applicants' magnetic holding force of 200%.

One object of our invention is to provide a magnetic fastener having a substantially doubled holding force.

Another object of our invention is to provide a magnetic fastener having respective male and female elements which resist lateral or sliding motion in a direction orthogonal to the air gaps.

A further object of our invention is to provide a magnetic fastener having relatively few parts which is of simple and inexpensive construction.

Other and further objects of our invention will appear from the following description.

BRIEF DESCRIPTION OF THE DRAWINGS

In the accompanying drawings which form part of the instant specification and which are to be read in conjunction therewith and in which like reference numerals are used to indicate like parts in the various views;

FIG. 1 is a sectional view of a first embodiment of our invention an interlocking fastener.

FIG. 2 is a sectional view on an enlarged scale of a modification of the first embodiment of our invention showing an interlocking fastener.

FIG. 3 is a sectional view of a second embodiment of our invention showing an interlocking fastener.

FIG. 4 is a sectional view of the first embodiment of our invention showing a non-interlocking fastener.

FIG. 5 is a sectional view of the second embodiment of our invention showing a non-interlocking fastener.

DESCRIPTION OF THE PREFERRED EMBODIMENTS

Referring more particularly now to FIG. 1 of the drawings, we provide a disc shaped permanent magnet 10 having a diameter of 0.67 inch and a thickness of 0.1 inch. Magnet 10 preferably comprises flexible, rubber-bonded, powdered and oriented barium ferrite crystals. The remanant or residual induction may be approximately 2,000 gauss. The south pole of magnet 10 is in contact with the bottom of a cup 12 formed of a permeable material such as steel having a saturation induction well in excess of 15,000 gauss and having a permeability of at least 100 at such flux density. The bottom of cup 12 may have a thickness of 22 mils. Cup 12 may have an outer diameter of 0.75 inch, and an inner diameter of 0.71 inch, The thickness of the upstanding wall of cup 12 may thus be 20 mils. The north pole of magnet 10 is covered with a pole plate 16 formed of a permeable material such as steel having a diameter of 0.67 inch and a thickness generally of 24 mils. Pole plate 16 is formed with an upstanding annular pole 18. The height of pole 18 should be greater than 4 mils but need not exceed 16 mils and is preferably of the order of magnitude of 8 mils. The radial thickness of the annular pole 18 may be 22.5 mils.

The magnetic fastener may be used as a closure for handbags. Abutting the bottom of cup 12 is a spring steel base 25 provided with a pair of depending prongs 24. Pole plate 16, magnet 10, the bottom of cup 12, and spring steel base 25 are each provided with a central 40 mil diameter hole which receives the shank of a rivet 30 having an enlarged head. Rivet 30 is formed of a non-permeable material such as brass, aluminum or zinc. Rivet 30 holds these four parts of the magnet assembly together, when its shank is upset by hammering or staking. The rubber-bonded permanent magnet 10 does not fracture or chip from the shocks caused by riveting or staking.

It will be noted that an annular air gap of 20 mils exists between the inner sidewall of cup 12 and the peripheries of both pole plate 16 and permanent magnet 10. This annular air gap prevents short-circuiting of the magnetic path.

The armature 20 comprises a flat disk of permeable material such as steel having a diameter slightly more than 0.75 inch and a thickness of 22 mils. Positioned on top of armature 20 is a spring steel base 27 provided with a pair of upstanding prongs 26. Spring steel base 27 may be secured to armature 20 by a pair of spot welds, as shown. Armature 20 is provided with a central hole 21; and spring steel base 27 is provided with a central hole 28. Holes 21 and 28 have a diameter slightly greater than that of the enlarged head of rivet 30 to provide a clearance fit. The head of rivet 30 may have a flat top with a rounded edge; and the lower portion of hole 21 may be rounded so that the armature and magnet assemblies may readily find and be seated against one another.

The upper surface of the upstanding sidewall of cup 12 defines an annular pole 14 which is concentric with pole 18; and the two polar surfaces should be co-planar. When the armature and magnet assemblies are engaged, flux from the north pole of magnet 10 is collected by pole plate 16. The collected flux flows radially through plate 16 to the outer margin of pole plate 16 and thence upwardly through pole 18 to armature 20. Flux then flows radially outwardly through armature 20 to its periphery and thence downwardly to pole 14. Flux then flows downwardly through the upstanding sidewall of cup 12 and then radially inwardly through the bottom of cup 12 to the south pole of permanent magnet 10. Half the total magnetic pull between the armature and magnet assemblies arises from pole 14; and the remaining half arises from pole 18.

For the dimensions given, the area of the north pole face of magnet 10 is 0.351 square inch. The area of each of pole faces 14 and 18 is 0.0459 square inch. When the armature and magnet assemblies are engaged, armature 20 is substantially flush against poles 14 and 18; and the "air gaps" therebetween are of substantially zero length. The flux densities in each of these minute air gaps above poles 14 and 18 is $0.351/.0459=7.66$ times that in the permanent magnet 10. Thus, if the remanent flux density in magnet 10 with the parts engaged is 2,000 gauss, the flux density in the minute air gaps above poles 14 and 18 will be $2{,}000(7.66)=15{,}320$ gauss.

It will be noted that the enlarged head of rivet 30 cooperates with the holes in armature 20 and base 27 to prevent lateral or sliding movement between the two assemblies.

As indicated by the dashed lines, armature 20 may be provided with a depending pole 18*a*. In such event, pole 18 may be omitted; and pole plate 16 would then comprise a disk of uniform thickness. It will also be appreciated that instead of providing an upstanding annular pole 18 on pole plate 16 or a depending annular pole 18*a* on armature 20, we may instead provide a plurality of discrete upstanding poles on plate 16 or a plurality of discrete depending poles on armature 20. We may alternatively provide one or more discrete upstanding poles on pole plate 16 and one or more discrete depending poles on armature 20. The total polar area, whether due to upstanding poles from plate 16 or depending poles from armature 20 or a combination of both, should be substantially the same as the area of pole 14 which in the example given is 0.0459 square inch.

Referring now to FIG. 2 of the drawings, the construction is generally the same as shown in FIG. 1. However, in FIG. 2, the upstanding pole 18 is formed in plate 16 by stamping or embossing between cooperating male and female dies, the male die leaving an annular depression or void in the undersurface of plate 16 of approximately trapezoidal shape. The average or mean diameter of the annular pole is preferably $$\sqrt{(.67^2 + .04^2)/2} = .671\ (.707) = .475 \text{ inch},$$

The flat top portion of annular pole 18 may have a radial thickness of 30.8 mils to provide an area of 0.0459 square inch. Pole plate 16 may have a reduced thickness of 16 mils; and pole 18 may extend above the surface of plate 16 by 8 mils. The inner and outer edges of pole 18 may be formed with a 45° chamfer, as shown. The trapezoidal void formed in the bottom of plate 16 may have a base of 35.4 mils and a depth of 16 mils. In order to collect the flux from the north pole of magnet 10 in the region of this void, there is provided between pole plate 16 and the north pole of magnet 10 a plate 15 formed of a permeable material, such as steel, having a thickness of 3 mils. Plate 15 is provided with a 40 mil diameter central hole to receive the shank of rivet 30. The thickness of armature 20 should be increased to 29 mils.

As indicated by the dashed lines, armature 20 may be provided with a depending annular pole 18*a*. In such event, pole 18 may be omitted; pole plate 16 would comprise a flat disk; and plate 15 may be omitted. As previously indicated, pole plate 16 may be provided with a plurality of discrete upstanding poles or armature 20 may be provided with a plurality of discrete depending poles. Alternatively, pole plate 16 may be provided with one or more upstanding poles and armature 16 may be provided with one or more depending poles. The total area of the pole or poles enabling flux flow from pole plate 16 to armature 20 should be substantially equal to that of pole 14, or 0.0459 square inch for the example given.

It will be understood that if pole 18 is formed in plate 16 by coining against a flat die, then the undersurface of plate 16 will be flat; and plate 15 may be omitted.

It will further be understood that plate 15 may be omitted to simplify the construction. The area of the base of the annular trapezoidal void is 0.053 square inch; and the effective north pole area of magnet 10 is reduced to 0.351 <0.053=0.298 square inch. If the areas of poles 14 and 18 are not changed, then the magnetic pull will be reduced to 200(0.298/0.351)=144%. Preferably the and 18 are reduced to 0.0459 (0.301/0.351)=0.0394 square inch to maintain the original flux density in the air gaps. The magnetic pull would then be 200(0.301/0.351)=172%. The radial thickness of the flat top portion of pole 18 is reduced to 30.8(0.301/0.351)=26.4 mils. The radial extent of the base of the trapezoidal void is reduced to 33.2 mils; and the area of the base of the annular trapezoidal void is now 0.050 square inch. The effective north pole area of magnet 10 is now 0.351−0.050=0.301 square inch. To reduce pole 14 to 0.0394 square inch, the inner diameter of the upstanding wall of cup 12 should be increased to 0.7158 inch, thereby reducing the wall thickness to 17.1 mils.

Referring now to FIG. 3, a rubber-bonded permanent magnet 10 has a thickness of 0.1 inch. Magnet 10 may have a diameter of 0.726 inch and is provided with a central hole of 0.282 inch diameter. Contacting the south pole of magnet 10 is a disk 12 formed of permeable material such as steel having a diameter of 0.726 inch and a thickness of 61 mils. Disk 12 is provided with a central hole of 40 mils diameter which receives the shank of a rivet 14 formed of permeable material such as steel and having an enlarged head or rod of 0.242 inch diameter. The north pole of magnet 10 is contacted by a pole plate 16 formed of a permeable material such as steel having a thickness of 40 mils. Pole plate 16 has; a diameter of 0.726 inch and is provided with a central hole of 0.282 inch diameter.

An annular air gap of 20 mils exists between the periphery of the head of permeable rivet 14 and the inner circumference of both pole plate 16 and magnet 10. This annular air gap prevents the short-circuiting of the magnetic path.

Positioned against the bottom of disk 12 is a spring steel base 25 which is provided with a pair of depending prongs 24. Base 25 is provided with a 40 mil hole which receives the shank of permeable rivet 14. Rivet 14 thus secures base 25 to disk 12.

An armature disk 20 formed of a permeable material such as steel has a thickness of 61 mils. The bottom surface of armature 20 is flat and has a diameter of 0.3716 inch. The lower edge of armature disk 20 is chamferred at a 45° angle; and armature disk 20 may have a diameter of 0.39 inch.

The area of each pole face of magnet 10 is 0.352 square inch; and the area of pole rod 14 is 0.0460 square inch. Thus, the flux density in pole rod 14 is 0.352/0.0460=7.65 times that in magnet 10. It is desired that the polar area between the armature and plate 16 be substantially equal to that of the pole rod 14. This polar area constitutes an annular region where the flat bottom surface of armature 20 overlaps pole plate 16. The outer margin 18*a* of this polar area is defined by the diameter of the flat bottom surface of armature 20. The inner margin 18 of this polar area is defined by the inner diameter or hole in plate 16. The annular polar area 18*a*-18 between armature 20 and plate 16 is $(0.3716^2-0.282^2)\pi/4=0.0460$ square inch, the same as pole rod 14.

Pole plate 16, magnet 10 and disk 12 are held together by a brass or other non-permeable casing 30 formed as an inverted cup. Casing 30 may have an outer diameter of 0.75 inch, an inner diameter of 0.728 inch, and a thickness of 11 mils. The top of inverted cup 30 is formed with a re-entrant hole 31 having a diameter somewhat greater than the 0.39 inch diameter of armature 20 to receive the armature with a slight clearance fit. The entrance to hole 31 has an appreciable radius and, in conjunction with the chamfer of armature 20, enables the armature assembly readily to find and be mated to the magnet assembly. With the assemblies mated, lateral or sliding motion of armature 20 is prevented by hole 31. The re-entrancy in the top of inverted cup 30 bears against pole plate 16. The lower lip of inverted cup 30 is provided with a plurality of three or more tabs such as 32 and 34 which are bent inwardly against the lower surface of disk 12 to complete the magnet assembly.

The armature assembly further includes a cover disk 22 which nearly abuts the top of inverted cup 30 when the assemblies are mated. Disk 22 may be formed of a non-permeable material such as brass or may preferably be formed of a permeable material such as steel. If disk 22 is formed of a permeable material, then the thickness of armature 20 may be correspondingly reduced. Armature 20 and disk 22 may be integrally formed. Disposed above disk 22 is a spring steel base 27 provided with a pair of upstanding prongs 26. Armature 20 may comprise the head of a rivet the shank of which is received by holes in disk 22 and base 27.

It will be understood that, if desired, pole plate 16 may be provided with an upstanding annular pole 18 (not shown) having an inner diameter of 0.282 inch and an outer diameter of 0.3716 inch with a corresponding radial thickness of 44.8 mils. In such event, the diameter of the flat bottom portion of armature 20 is no longer critical and may be increased to 0.375 inch; and the lower edge of armature 20 may be formed with a radius instead of a chamfer.

The interlocking embodiments of FIGS. 1, 2 and 3 all provide substantially identical magnetic holding forces and prevent lateral sliding motion of the two assemblies after mating. The embodiments of FIGS. 1 and 2 are preferred since they require the least amount of permeable material; and the fastener has the least height. In FIGS. 1 and 2 the annular pole 14 has the largest possible diameter. In FIG. 2, the thickness of armature 20 is increased by 29-22=7 mils from FIG. 1, but the thickness of pole plate 16 is reduced by 24-16=8 mils. In FIG. 3, the central pole rod 14 has a very small diameter; and disk 12, armature 20 and pole plate 16 each have an appreciably increased thickness.

Referring now to FIG. 4, there is shown a fastener similar to FIG. 1 but which may be attached to the permeable steel wall 20 of, for example, a refrigerator. Pole plate 16 is provided with a central recess 17 to receive the head of a non-permeable rivet 30 which may be formed of brass or zinc. The head of rivet 30 should have a sufficiently small height that there is an appreciable clearance gap between it and the wall of the refrigerator so as to permit poles 14 and 18 to contact wall 20. Disposed against the bottom of cup 12 is a plate 25 provided with a hole which receives the shank of rivet 30. Plate 25 mounts a hook 23 from which may be suspended various light articles such as potholders and oven gloves.

FIG. 5 shows a fastener similar to FIG. 3 but which may be attached to a permeable steel wall 20. Pole plate 16 is provided with an upstanding annular pole 18 and with a peripheral chamfer which receives the inwardly turned upper edge of a cylindrical casing 30 formed of a non-permeable material such as brass or aluminum. Disposed against the bottom of disk 12 is a plate 25 provided with a hole which receives the shank of permeable pole rod rivet 14. Plate 25 mounts a hook 23. The lower edge of casing 30 is provided with at least three tabs 32 and 34 which are bent inwardly against the lower surface of disk 12. Assuming the dimensions in FIG. 5 to be generally the same as in FIG. 3, the average or mean diameter of pole 18 is preferably $$\sqrt{(.726^2 + .282^2)/2} = .551 \text{ inch.}$$

The radial thickness of pole 18 is 26.6 mils to provide a pole area of 0.0460 square inch. The thickness of pole plate 16 may be 14 mils.

In FIGS. 1, 2 and 3, the permeable steel parts including the faces of poles 14 and 18 as well as the opposed face of armature 20 may be plated with a thin coating of a protective material such as nickel, zinc or gold. These are usually less than 0.1 mil thick and introduce an "air gap" of less than 0.2 mil between the pole faces and the armature. In FIGS. 1 and 2, pole 18 has a height of 8 mils which is 8/0.2=40 times the "air gap" caused by the platings.

In FIGS. 4 and 5, the wall 20 of a refrigerator may be protected by an enamel coating having an appreciably greater thickness. Accordingly in FIGS. 4 and 5, the height of pole 18 should be increased to at least 16 mils.

In FIGS. 4 and 5, the maximum weight which can be placed on hook 23 is equal to the product of the magnetically provided normal force and the relatively low coefficient of friction of the pole faces bearing against wall 20.

In both FIGS. 4 and 5, we provide a friction washer 19 formed of a medium durometer elastomer such as rubber or neoprene. The outer diameter of washer 19 is slightly greater than the inner diameter of pole 18 so that washer 19 may be press fitted into place. The thickness of washer 19 should be slightly greater than the height of pole 18, so that washer 19 protrudes slightly above the plane of the faces of poles 14 and 18 by one mil, for example. Preferably washer 19 is a composite comprising a low durometer upper layer bonded to a high durometer lower layer. Alternatively washer 19 may comprise a low durometer elastomer which is bonded to the upper surface of pole plate 16. Friction washer 19 contacts wall 20; and the high friction coefficient increases the weight which can be carried by hook 23 without the fastener sliding down wall 20.

We have assumed throughout that the upper pole of magnet 10 is north and that the lower pole of magnet 10 is south. However it will be understood that the pole polarities may be reversed; and the magnetic holding force will be the same.

It will be seen that we have accomplished the objects of our invention. Our magnetic fastener has a substantially doubled holding force. Interlocking male and female elements prevent lateral sliding motion, one element being permeable and the other element being non-permeable. Our fastener has few parts and is of a simple and inexpensive construction.

It will be understood that certain features and subcombinations are of utility and may be employed without reference to other features and subcombinations. This is contemplated by and is within the scope of our claims. It will further be obvious that various changes made be made in details without departing from the spirit of our invention.

Having thus described our invention what we claim is:

1. A magnetic fastener including in combination an armature formed of a magnetically permeable material having a generally planar surface, a cylindrical permanent magnet having respective north and south pole faces each extending parallel to said surface, one pole face being disposed adjacent said surface and the other pole face being disposed remote from said surface, magnetically permeable means for coupling flux from said remote pole face to a point in close proximity to said surface, magnetic flux flowing between said coupling means and said surface through a first air gap of predetermined cross-sectional area which is much smaller than the area of a pole face, and a layer of magnetically permeable material having an area substantially equal to that of an covering said adjacent pole face, said armature and said layer being so constructed that flux flows between said layer and said surface through a second air gap having approximately said predetermined cross-sectional area.

2. A fastener as in claim 1 wherein the magnetic coupling means comprises a cup-shaped member having a lip which defines the area of the first air gap.

3. A fastener as in claim 1 wherein the cylindrical permanent magnet is provided with an axial hole and wherein the magnetic coupling means comprises a cylindrical rod disposed within said hole.

4. A fastener as in claim 1 wherein the layer is constructed to include an upstanding permeable pole.

5. A fastener as in claim 1 wherein the layer is constructed to include an annular upstanding permeable pole.

6. A fastener as in claim 1 wherein the armature is constructed to include a permeable pole depending from said surface into proximity with the layer.

7. A fastener as in claim 1 wherein the armature is constructed to include an annular permeable pole depending from said surface into proximate with the layer.

8. A fastener as in claim 1 wherein the layer is constructed to include an upstanding permeable pole and the armature is constructed to include a permeable pole depending from said surface into proximity with the layer.

9. A fastener as in claim 1 wherein the layer is constructed to include an upstanding permeable pole formed by embossing.

10. A fastener as in claim 1 wherein the layer is constructed to include an upstanding permeable pole formed by embossing, further including a sheet of magnetically permeable material disposed between said adjacent pole face and said layer.

11. A fastener as in claim 1 wherein the permanent magnet and the layer are provided with axial holes of the same first area and wherein said planar armature surface has a second area greater than the first area, the second air gap having a cross-sectional area equal to the difference between said second and first areas.

12. A magnetic fastener including in combination a cup-shaped member formed of a magnetically permeable material, a cylindrical permanent magnet disposed within the cup, a non-permeable magnetically rivet having a head and a shank, said shank extending through a hole formed along the axis of the magnet and through a central hole formed in the bottom of the cup, said shank being upset and acting upon the cup to hold the magnet and cup together, said head extending above the lip of the cup, a magnetically permeable armature having a planar surface disposed in close proximity to the lip of the cup, said armature being formed with a hole which closely receives said rivet head.

13. A magnetic fastener including in combination a cup-shaped member formed of a magnetically non-permeable material, the bottom of the cup being formed with an upwardly extending re-entrancy defining a hole, a first disk formed of a magnetically permeable material disposed within the cup and bearing against the upwardly extending re-entrancy, a cylindrical permanent magnet disposed within the cup and bearing against the first disk, a second disk formed of a permeable material disposed within the cup and bearing against the magnet, the lip of the cup being provided with a plurality of tabs which are adapted to be bent inwardly and downwardly against the second disk, and an armature disk formed of a permeable material and adapted to be inserted upwardly through the re-entrant hole into proximity with the first disk.

14. A magnetic fastener including in combination a magnetically permeable armature having a generally planar surface, a cylindrical permanent magnet having a north and a south pole face, means including a first pole piece formed of a magnetically permeable material for coupling magnetic flux from the north pole face to the armature through a first air gap, and means including a second pole piece formed of a magnetically permeable material for coupling magnetic flux from the armature to the south pole face through a second air gap, the first and second air gaps

15. A fastener as in claim 12, wherein the magnet is rubber-bonded.

16. A fastener as in claim 13 wherein the magnet is rubber-bonded.

17. A magnetic fastener including in combination an armature formed of a magnetically permeable material having a generally planar surface, a cylindrical permanent magnet having respective north an south pole faces each extending parallel to said surface, one pole face being disposed adjacent said surface and the other pole face being disposed remote from said surface, magnetically permeable means for coupling flux from said remote pole face to a point in close proximity to said surface, magnetic flux flowing between said coupling means and said surface through a first air gap of predetermined cross-sectional area which is much smaller than the area of a pole face, a layer of magnetically permeable material having an area substantially equal to that of and covering said adjacent pole face, said armature and said layer being so constructed that flux flows between said layer and said surface through a second air gap having approximately said predetermined cross-sectional area, and a single unitary magnetically non-permeable member adapted to hold together the coupling means and the magnet and the layer, said member including a fixed portion acting upon the layer and a portion deformable to act upon the coupling means.

18. A fastener as in claim 17 wherein the magnet is rubber-bonded.

19. A magnetic fastener including in combination a magnetically permeable armature having a generally planar surface, a cylindrical permanent magnet having a north and a south pole face, means including a first pole piece formed of a magnetically permeable material for coupling magnetic flux from the north pole face to the armature through a first air gap, means including a second pole piece formed of a magnetically permeable material for coupling magnetic flux from the armature to the south pole face through a second air gap, the first and second air gaps having approximately equal areas each of which is much smaller than that of either pole face, one of the coupling means including a layer of magnetically permeable material having an area substantially equal to that of an covering its associated pole, face, and a single unitary magnetically non-permeable member adapted to hold together the layer and the magnet and the other coupling means, said member including a fixed portion acting upon the layer and a portion deformable to act upon said other coupling means.

20. A fastener as in claim 19 wherein the magnet is rubber-bonded.

* * * * *

UNITED STATES PATENT AND TRADEMARK OFFICE
CERTIFICATE OF CORRECTION

PATENT NO. : 4,825,526

DATED : May 2, 1989

INVENTOR(S) : Richard S. Shenier and Richard J. Peterson

It is certified that error appears in the above-identified patent and that said Letters Patent is hereby corrected as shown below:

First page, second column, line 20 - "20 Claims, 1 Drawing Sheet" should read -- 19 Claims, 1 Drawing Sheet --.

Column 9, line 5 - "an" should read -- and --.

Column 9, line 27 - "proximate" should read -- proximity --.

Column 9, line 43 - insert -- substantially -- before "the same first area".

Column 9, line 49 - "non-permeable magnetically" should read -- magnetically non-permeable --.

Column 9, line 58 - Claim 13 should read as follows:

-- 13. A magnetic fastener as in Claim 1 further including means including a washer formed of a magnetically non-permeable elastomeric material having a high coefficient of friction and adapted to bear against the armature for maintaining a slight spacing in said air gaps. --

Column 10, line 16 - after "gaps" insert

-- having approximately equal areas each of which is much smaller than that of either pole face, one of the coupling means including a layer of magnetically permeable material having an area substantially equal to that of and covering its associated pole face. --

UNITED STATES PATENT AND TRADEMARK OFFICE

CERTIFICATE OF CORRECTION

PATENT NO. : 4,825,526

DATED : May 2, 1989

INVENTOR(S) : Richard S. Shenier and Richard J. Peterson

It is certified that error appears in the above-identified patent and that said Letters Patent is hereby corrected as shown below:

Column 10, line 19 - delete "16. A fastener as in claim 13 wherein the magnet is rubber-bonded."

Column 10, line 21 - change "17" to -- 16 --.

Column 10, line 24 - "an" should read -- and --.

Column 10, line 44 - change "18" to -- 17 --.

Column 10, line 44 - change "17" to -- 16 --.

Column 10, line 46 - change "19" to -- 18 --.

Column 10, line 60 - "an" should read -- and --.

Column 10, line 67 - change "20" to -- 19 --.

Column 10, line 67 - change "19" to -- 18 --.

Signed and Sealed this

Ninth Day of January, 1990

*Attest:*

JEFFREY M. SAMUELS

*Attesting Officer*

*Acting Commissioner of Patents and Trademarks*